US006334290B1

(12) United States Patent
Reichert et al.

(10) Patent No.: US 6,334,290 B1
(45) Date of Patent: Jan. 1, 2002

(54) APPARATUS FOR PRODUCING PACKAGES

(75) Inventors: Manfred Reichert, Remshalden; Martin Weinmann, Leinfelden-Echterdingen, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/551,207

(22) Filed: Apr. 17, 2000

(30) Foreign Application Priority Data

Apr. 17, 1999 (DE) ..... 199 17 442

(51) Int. Cl.[7] ..... B65B 47/00

(52) U.S. Cl. ..... 53/559; 53/561; 53/578; 53/324

(58) Field of Search ..... 53/559, 561, 547, 53/578, 586, 296, 298, 300, 324, 329

(56) References Cited

U.S. PATENT DOCUMENTS 3,808,772 A * 5/1974 Turtschan ..... 53/559
4,092,817 A * 6/1978 Rist ..... 53/298
4,165,594 A * 8/1979 Corbic ..... 53/559
4,282,699 A * 8/1981 Embro ..... 53/298
4,565,052 A * 1/1986 Hautemont ..... 53/559
5,010,714 A * 4/1991 Medwed et al. ..... 53/559

* cited by examiner

*Primary Examiner*—Peter Vo
*Assistant Examiner*—Sam Tawfik
(74) *Attorney, Agent, or Firm*—Ronald E. Greigg

(57) ABSTRACT

An apparatus for producing packages having a heating device for heating a bottom sheeting strip, a forming device, a filling device, a sealing device for sealing on a top strip, and a cutting device for separating the packages. For forming downward-drawn rims on the packages that make them easy to drink from, additional recesses are embodied in the forming device, and the bottom sheeting strip is pressed by means of protrusions into recesses disposed on the upper part of the forming device. The cutting device also has a stamping knife, which cuts the package out of the foil composite in the region of the downward-drawn rim.

3 Claims, 2 Drawing Sheets

APPARATUS FOR PRODUCING PACKAGES

BACKGROUND OF THE INVENTION

The invention relates to an apparatus for producing packages. Known apparatuses of this kind are used for making plastic cups filled with a food, such as yogurt or juice. A disadvantage of the known apparatuses is that they create a flat rim extending all the way around. This often sharp-edged rim is unpleasant to the user if the plastic cup is used as a drinking cup at the same time. For this reason, cups with a downward-drawn or rounded rim are already known. However, these cups are made either by injection molding, or if they are made by deep drawing, then the rim is formed, on an additional piece of equipment, only after the packages have been filled and separated. It is therefore an object of the invention to refine an apparatus of this generic type in such a way that packages with a downward-drawn rim region can be produced without additional, separate equipment.

OBJECT AND SUMMARY OF THE INVENTION

The apparatus according to the invention for producing packages has the advantage that by integrating the production of downward-drawn rims with the thermoforming system, the rims can be created directly in the thermodeformable strip, and the packages do not have to be separated beforehand. This makes it possible to achieve a relatively simple design of the apparatus as well as high capacity. as high capacity.

The invention will be better understood and further objects and advantages thereof will become more apparent from the ensuing detailed description of a single exemplary embodiment taken in conjunction with the drawing.

DESCRIPTION OF THE PREFERRED EMBODIMENT

Figure 1:
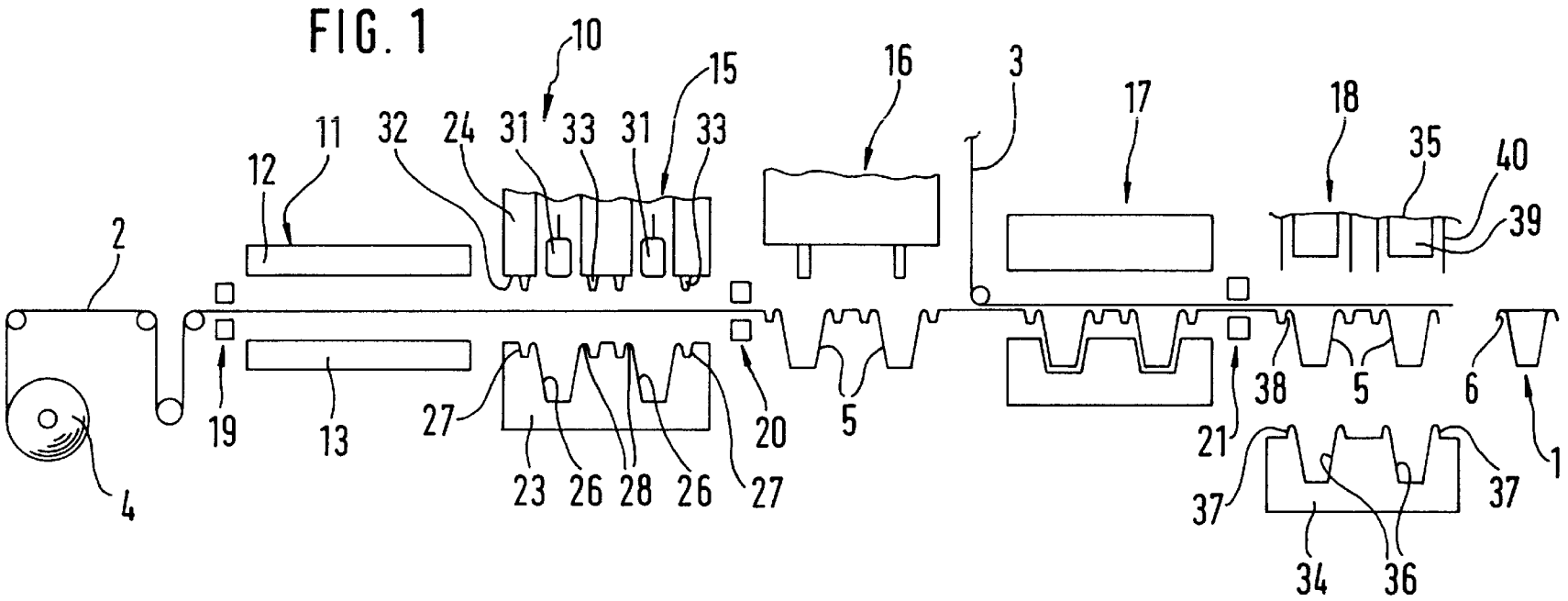
FIG. 1 is a simplified side view of an apparatus for producing packages.

An apparatus 10 for producing filled packages 1 is shown in FIG. 1. The apparatus 10 has a heating station 11 with at least two heating plates 12, 13 disposed on both sides of a thermodeformable bottom strip 2, and also has a forming station 15, a filling station 16, a sealing station 17 for sealing on a top foil strip 3, and a cutting station 18.

Longitudinally of both sides of the feeding path of the bottom strip 2, feeding devices are provided, in the form of reciprocating pairs 19, 20, 21 of clamping tongs that open and close and that pull the bottom strip 2 from a roll 4 and intermittently feed the strip through the individual processing stations of the apparatus 10.

The heating station 11, filling station 16 and sealing station 17 are of known designs and will therefore not be described in further detail here. What is essential to the invention is the embodiment of the forming station 15 and the cutting station 18. The forming station 15 has a lower part 23 and an upper part 24, which can be moved toward and away from one another. First recesses 26 for forming the slightly conical container bodies 5 and second recesses 27, each for forming an encompassing, downward-drawn container rim 6, are embodied in the lower part 23. As seen best in FIG. 2, an at least partly flat middle portion 28 is embodied between the first recess 26 and the second, annularly encompassing recess 27. In the further course of operations, the middle portion 28 embodies the bearing surface for sealing on the top foil strip 3. The second recess 27 is embodied obliquely, at least in the lower region 29 of the container rim, pointing in a direction away from the container body 5. For forming the container bodies 5, raisable and lowerable prestretching dies 31 are disposed in the upper part 24, along with compressed air nozzles or the like, not shown. On the underside 32 of the upper part 24, there are also encompassing protrusions 33, which are adapted to the shape of the second recesses 27 and cooperate with them.

Figure 3:
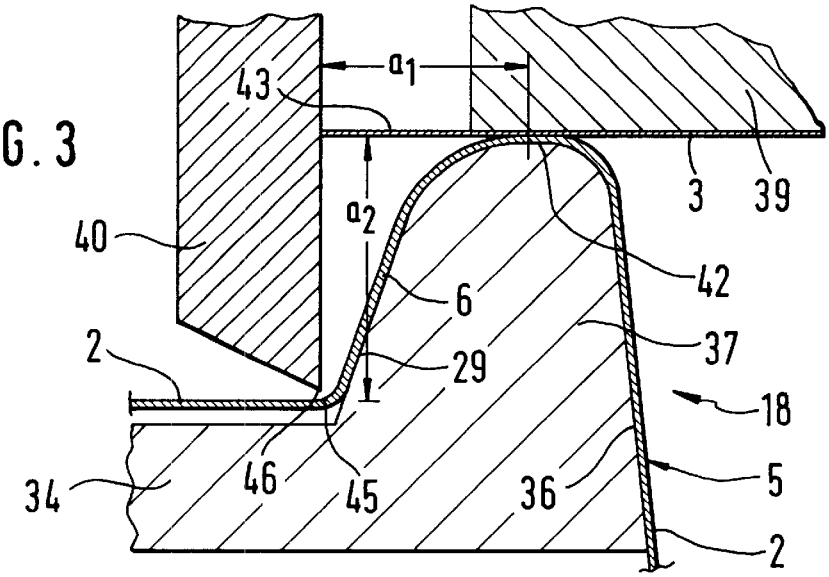
FIG. 3 is a side view of part of a cutting device.

As FIG. 1 in conjunction with FIG. 3 shows, the cutting station 18 has a lower part 34 and an upper part 35, which can both be moved toward and away from one another. Recesses 36 adapted to the shape of the container bodies 5 are embodied in the lower part 34. What are essential are also encompassing support rims 37, whose shape is adapted to the shape of the inside 38 of the container rims 6, so that the support rims 37, together with the recesses 36, receive the container bodies 5 by positive engagement. Holding-down devices 39, which are surrounded by sleeve-like circular stamping knives 40, are integrated into the upper part 35. As best seen from FIG. 3, the holding-down device 39 has a diameter which protrudes somewhat past the flat sealing region 42 on the container body 5. In a preferred embodiment of the invention, the spacing a1 from the sealing region 42 on the container body 5 to the stamping knife 40 is selected to be great enough that the annularly encompassing portion 43, protruding from the sealing region 42 to the stamping knife 40, of the top foil strip 3 can be grasped with the fingers and used as an aide in opening the package 1. In order to make a container rim 6 as user-friendly as possible, the dimension a2 is furthermore selected to be so great that when someone drinks out of the package 1, the container rim 6 will not injure his lips that are contacting the edge of the package. FIG. 3 also shows that the downward-drawn container rim 6 has to be embodied in such a way that the stamping edge, indicated at 45, can be engaged by the stamping knife 40 moving vertically from top to bottom. This means that the stamping edge 45 is spaced farther from the container body 5 than are the other points of the container rim 6.

The stamping knife 40 has an encompassing cutting edge 46. To make it simpler to sever the top foil strip 3, it is preferably provided that the cutting edge 46 extends not in a parallel plane relative to the top foil strip 3 or the lower part 34, but instead has at least one point with a somewhat lesser spacing. As a result, when the cutting edge 46 of the stamping knife 40 meets the top side of the top foil strip 3, local peak tensions are created, at which the top foil strip 3 is first severed or first tears.

Figure 4:
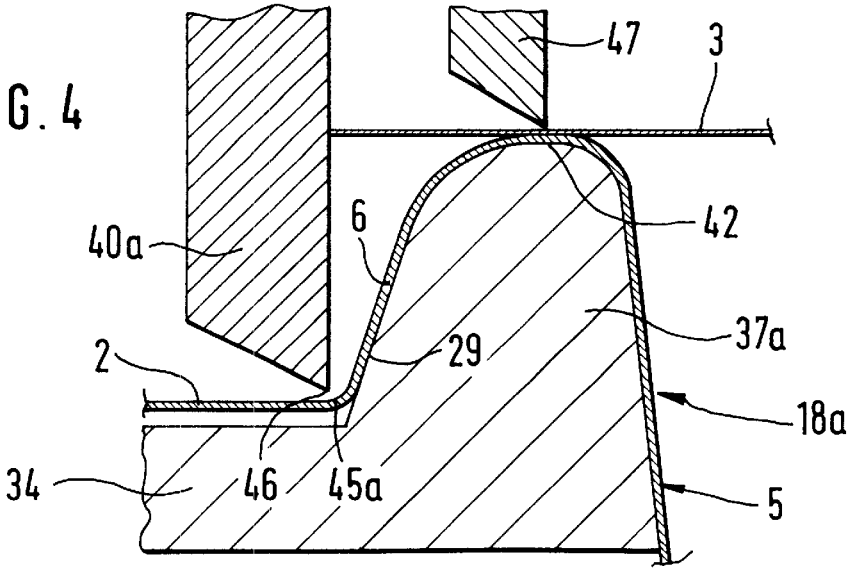
FIG. 4, again in side view, shows a part of a cutting device that is modified compared with FIG. 3.

In the exemplary embodiment shown in FIG. 4, a cutting station 18*a* is employed that differs from the cutting station 18 in particular in having the presence of a second stamping knife 47. The second stamping knife 47, which is disposed concentrically with the first stamping knife 40*a*, is provided whenever it is undesirable to have a portion 43 of the top foil strip 3 protruding past the sealing region 42 and serving as an aide in opening the container. For that case, it is preferably provided that the second stamping knife 47 is in advance of the first stamping knife 40*a* in terms of its motion, or in other words meets the sealing region 42 before the first stamping knife 40*a* forms the stamping edge 45*a*, because in that case the second stamping knife 47, together with the support rim 37*a* provides for additional centering of the package 1 in the cutting station 18*a*.

Mode of Operation

Figure 2:
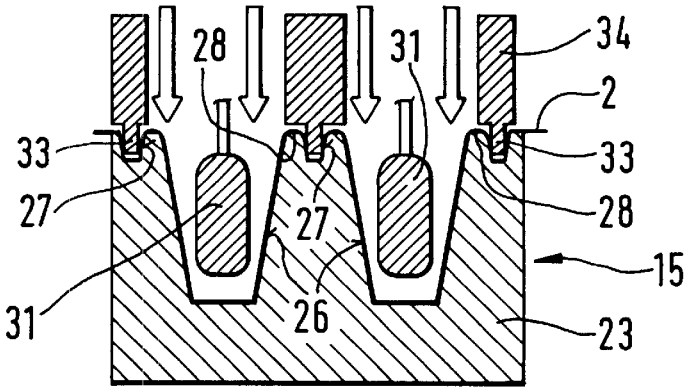
FIG. 2 is a side view of a forming device.

The apparatus 10 described above functions as follows: The bottom strip 2 is advanced intermittently through the apparatus 10 by the pairs 19, 20, 21 of clamping tongs, first being heated in the heating station 11 to the temperature required for the ensuing molding process. Next, the bottom strip 2 enters the forming station 15, where the lower part 23 and top part 24 of the station are moved toward one another, thus forming the container rims 6 in the bottom strip 2. Next, the prestretching dies 31 move downward, in order to indent the bottom strip 2 about the first recesses 26. The molding process is concluded by compressed air (or a vacuum applied to the first recesses 26), which by positive engagement presses the bottom strip 2 into the first recesses 26 (FIG. 2). After the ensuing feeding increment, the molded container bodies 5 have reached the region of the filling station 16, where a certain quantity of a filling product is metered into the container bodies 5. In the following sealing station 17, the top foil strip 3 is sealed onto the top side of the container bodies 5 by the action of heat and pressure in the region of the sealing regions 42. Finally, the container bodies 5, now provided with the top foil strip 3, enter the region of the cutting station 18, 18*a*.

In the case of the cutting station 18 (FIG. 3), the holding-down device 39 moves in advance of the stamping knife 40, so that the holding-down device 39, together with the support rim 37, centers the container body 5 in the cutting station 18. What is also essential is that during the centering, no tensile or compressive stresses are exerted by the pairs 19, 20, 21 of clamping tongs on the composite comprising the bottom strip 2 and the top foil strip 3. Only once the holding-down devices 39 are seated on the top side of the packages 1 does the stamping knife 40 sever the top foil strip 3 and, as operation continues, cut individual packages 1 out of the bottom strip 2.

In the case of the cutting station 18*a* (FIG. 4), the second cutting knife 47, as already noted, serves to center the container bodies 5 in the cutting station 18*a*. Only once the centering has been accomplished does the second stamping knife 47 sever the top foil strip 3, while the stamping knife 40*a* is cutting the packages 1 out of the bottom strip 2.

It will also be noted as a supplement that the apparatus 10 can be modified or changed in manifold ways. For instance, it is conceivable to embody the apparatus 10 as a packaging machine that operates aseptically, so that it can also be used for filling containers with foods that are critical in terms of spoilage. Furthermore, instead of single packages 1, groups of packages 1 cohering with one another can be produced in the forming station and the cutting station. In that case, it is understood that corresponding design changes are required both in the forming station and in the cutting station. Another modification pertains to the embodiment of the stamping 40 (FIG. 3): Instead of a stamping knife that has a circular cutting edge and creates an annular aide (portion 43) in opening the container, the stamping knife can also have an embodiment such that it creates a protruding opening tab in the portion 43, while the remainder of the top foil strip is severed directly at the portion 42, similarly to what is shown in FIG. 4.

The foregoing relates to a single exemplary embodiment of the invention, it being understood that other variants and embodiments thereof are possible within the spirit and scope of the invention, the latter being defined by the appended claims.

We claim:

1. An apparatus (10) for producing packages (1), comprising a heating device (11) for heating a thermodeformable bottom sheeting strip (2), a forming device (15) for molding container bodies into a bottom sheeting strip (2), the forming device (15) having a lower part (23) and an upper brace (24) that cooperates with the lower part (23), a filling device (16) for filling the molded container bodies (5) with a filling product, a sealing device (16) for sealing a top foil strip (3) to the top of the container bodies (5), and a cutting device (18; 18*a*) for cutting at least one package (1) at a time out of the foil strip, in which the brace (24) in the forming device (15) has one protrusion (33) for each container body (5), for molding a rim (16), drawn downward on an outside, on the container body (5); that the protrusion (33) cooperates with a corresponding recess (27) in the lower part (23) of the forming device (15); and that the cutting device (18; 18*a*) has a circular cutting knife (40; 40*a*) with a circular cutting edge, which cuts the packages (1) from the foil strip in the region of the downward-drawn rims (6), wherein the cutting device (18; 18*a*) has a lower part (34), which functions as a brace for the cutting knife (40; 40*a*), support rims (37; 37*a*) are included on the brace and the support rims engage the insides (38) of the downward-drawn rims (6) of the packages (1).

2. The apparatus according to claim 1, in which the lower part (34) of the cutting device cooperates with a holding-down device (39), which is lowered onto the top of the packages (1).

3. The apparatus according to claim 1, in which the cutting device (18*a*) has first and second stamping knives (40*a*, 47), disposed concentrically to one another, the first stamping knive (40*a*) creates a downward-drawn rim (6), and the second stamping knive (47) cooperates with the support rim (37*a*) and severs a foil strip (3) in a region of a sealing rim (42).

* * * * *